US009429161B2

(12) United States Patent
Park

(10) Patent No.: US 9,429,161 B2
(45) Date of Patent: Aug. 30, 2016

(54) METHOD OF CONTROLLING COMPRESSOR SYSTEM FOR PREVENTING SURGE OCCURRENCE AND COMPRESSOR SYSTEM USING THE SAME

(71) Applicant: HANWHA TECHWIN CO.,LTD., Changwon-si (KR)

(72) Inventor: Sung-soon Park, Changwon (KR)

(73) Assignee: Hanwha Techwin Co., Ltd., Changwon-si (KR)

( * ) Notice: Subject to any disclaimer, the term of this patent is extended or adjusted under 35 U.S.C. 154(b) by 617 days.

(21) Appl. No.: 13/848,881

(22) Filed: Mar. 22, 2013

(65) Prior Publication Data

US 2013/0251503 A1 Sep. 26, 2013

(30) Foreign Application Priority Data

Mar. 23, 2012 (KR) ..... 10-2012-0030001

(51) Int. Cl.
*F04D 15/00* (2006.01)
*F04D 27/00* (2006.01)

(52) U.S. Cl.
CPC ..... *F04D 15/00* (2013.01); *F04D 27/001* (2013.01)

(58) Field of Classification Search
CPC ..... F04D 15/00; F04D 27/001
USPC ..... 415/1, 13, 17, 30; 417/42, 43, 44.1, 417/44.2
See application file for complete search history.

(56) References Cited

U.S. PATENT DOCUMENTS

| | | | | |
|---|---|---|---|---|
| 4,831,534 | A * | 5/1989 | Blotenberg | F04D 27/0284 415/1 |
| 4,831,535 | A | 5/1989 | Blotenberg | |
| 5,762,468 | A * | 6/1998 | Blotenberg | F04D 27/023 415/26 |
| 6,317,655 | B1 * | 11/2001 | Khots | F04D 27/001 700/275 |
| 2004/0151576 | A1 * | 8/2004 | Blotenberg | F04D 27/02 415/1 |
| 2007/0039320 | A1 | 2/2007 | Gu et al. | |
| 2008/0264067 | A1 | 10/2008 | Flucker et al. | |
| 2012/0121440 | A1 | 5/2012 | Powell | |

FOREIGN PATENT DOCUMENTS

| | | | |
|---|---|---|---|
| EP | 1 548 236 | A2 | 6/2005 |
| JP | 8-144993 | A | 6/1996 |
| JP | 2001-123852 | A | 5/2001 |
| JP | 2005-146927 | A | 6/2005 |
| JP | 2005-188411 | A | 7/2005 |
| JP | 2005-226561 | A | 8/2005 |
| JP | 2007-212040 | A | 8/2007 |
| KR | 10-2010-0072197 | A | 6/2010 |

* cited by examiner

*Primary Examiner* — Hoang Nguyen
(74) *Attorney, Agent, or Firm* — Sughrue Mion, PLLC

(57) ABSTRACT

Provided is a method of controlling a compressor system including measuring variables for generating a performance curve of a compressor, calculating changing rates of the variables; comparing the calculated changing rates with preset changing rate variations; and determining a surge control line different from a preset surge control line according to the calculated changing rates if the calculated changing rates are out of ranges of the preset changing rate variations.

19 Claims, 4 Drawing Sheets

METHOD OF CONTROLLING COMPRESSOR SYSTEM FOR PREVENTING SURGE OCCURRENCE AND COMPRESSOR SYSTEM USING THE SAME

CROSS-REFERENCE TO RELATED APPLICATION

This application claims priority from Korean Patent Application No. 10-2012-0030001, filed on Mar. 23, 2012, in the Korean Intellectual Property Office, the disclosure of which is incorporated herein by reference in its entirety.

BACKGROUND

1. Field

Apparatuses and methods consistent with exemplary embodiments relate to a method of controlling a compressor system and a compressor system using the same, and more particularly, to a method of controlling a compressor system for preventing an occurrence of a surge and a compressor system using the same.

2. Description of the Related Art

When a turbo compressor fails to produce a pressure greater than a pressure resistance of a turbo compressor system, reverse flows occur in the turbo compressor. The phenomenon is referred to as a surge. When a surge occurs, flow is reversed, and thus, the pressure and flux are minutely changed. These changes cause mechanical oscillations, thereby causing damages to bearings and impellers of the turbo compressor system. In other words, the surge is a phenomenon that deteriorates the performance and shorten the lifespan of compressor components. Therefore, providing surge protection is a core feature of controlling a turbo compressor.

In the related art, to prevent the occurrence of a surge in a compressor system, a surge control line is set on a performance chart of the compressor system and the compressor system is controlled according to the surge control line. Particularly, a method of controlling a compressor system using such surge control line is disclosed in Japanese Patent Laid-Open Publication No. 2007-212040 (Title of the Invention: Turbo Refrigerator and its Control Method, Applicant: Mitsubishi Heavy Industry Ltd). The Japanese Patent Laid-Open Publication No. 2007-212040 discloses a technique for setting a surge control line, which has about 10% margin from a surge line set on a performance chart, and controlling a compressor system by opening of an inlet vane and a hot gas bypass according to the surge control line.

Furthermore, Japanese Patent Laid-Open Publication No. 2005-226561 (Title of the Invention: Low Duty Compressor Control Method in LNG ship, Applicant: Kawasaki Shipbuilding Corp.) discloses a technique for setting a surge control zone instead of a surge control line and keeping an operation point out of the surge control zone for surge protection.

SUMMARY

One or more exemplary embodiments provide a method of controlling a compressor system for preventing occurrence of a surge in the compressor system by changing a surge control line and a compressor system using the method.

Additional aspects will be set forth in part in the description which follows and, in part, will be apparent from the description, or may be learned by practice of the presented embodiments.

According to an aspect of an exemplary embodiment, there is provided a method of controlling a compressor system including measuring variables for generating a performance curve of a compressor; calculating changing rates of the variables; comparing the calculated changing rates with preset changing rate variations; and determining a surge control line different from a preset surge control line according to the calculated changing rates if the calculated changing rates are out of the ranges of the preset changing rate variations.

The variables include a first variable and a second variable different from the first variable.

The method further includes calculating a first parameter and a second parameter by non-dimensionalizing the changing rate of the first variable and the changing rate of the second variable.

The first parameter and the second parameter are calculated according to equations $$P1 = \frac{\dot{X}}{X} \text{ and } P2 = \frac{\dot{Y}}{Y},$$

wherein the P1 denotes the first parameter and the P2 denotes the second parameter, X denotes the first variable of the compressor, $\dot{X}$ denotes a changing rate of the first variable, Y denotes the second variable of the compressor, and $\dot{Y}$ denotes the changing rate of the second variable.

The method may further include selecting a greater one of the first parameter and the second parameter as a control reference value.

The method further includes selecting and changing the surge control line corresponding to the control reference value.

The preset changing rate variations comprise a changing rate of the first variable and a changing rate of the second variable, the changing rates changed by adjusting opening of a blow-off valve with respect to lapse of time.

The surge control line is shifted from the preset surge control line according to a difference between the calculated changing rate of the variables and the preset changing rate variations.

The first variable comprises any one of a flow introduced to the compressor, a current applied to the compressor, and power applied to the compressor.

The second variable comprises any one of an ejection pressure of the compressor, a pressure ratio of the compressor, and an ejection head of the compressor.

According to an aspect of another exemplary embodiment, there is provided a compressor system including a compressor which compresses a fluid from the outside; a variable measuring sensor arranged at a side of the compressor which measures variables for generating a performance curve of the compressor; and a control unit which calculates a changing rate of the measured variables, compares the calculated changing rate with a preset changing rate variations, and determines a surge control line that is different from a preset surge control line.

The compressor system may further include an ejection line that is connected to the compressor and ejects a fluid compressed by the compressor; a branch line which is branched from the ejection line; and a blow-off valve which is installed on the branch line and controls flux of the fluid flowing into the branch line and exiting the compressor system.

The control unit controls opening of the blow-off valve according to the determined surge control line.

The variables may include a first variable and a second variable different from the first variable.

The preset changing rate variations may include a changing rate of the first variable and a changing rate of the second variable, the changing rates changed by adjusting opening of the blow-off valve with respect to lapse of time.

The control unit may further calculate a first parameter and a second parameter by non-dimensionalizing the changing rate of the first variable and the changing rate of the second variable.

The control unit may further select a greater one of the first parameter and the second parameter as a control reference value.

The control unit may change the surge control line based on the control reference value.

The surge control line may be shifted from the preset surge control line according to a difference between the calculated changing rate of the measured variables and the preset changing rate variations.

BRIEF DESCRIPTION OF THE DRAWINGS

The above and/or other aspects will become apparent and more readily appreciated from the following description of exemplary embodiments, taken in conjunction with the accompanying drawings of which.

DETAILED DESCRIPTION OF EXEMPLARY EMBODIMENTS

Figure 1:
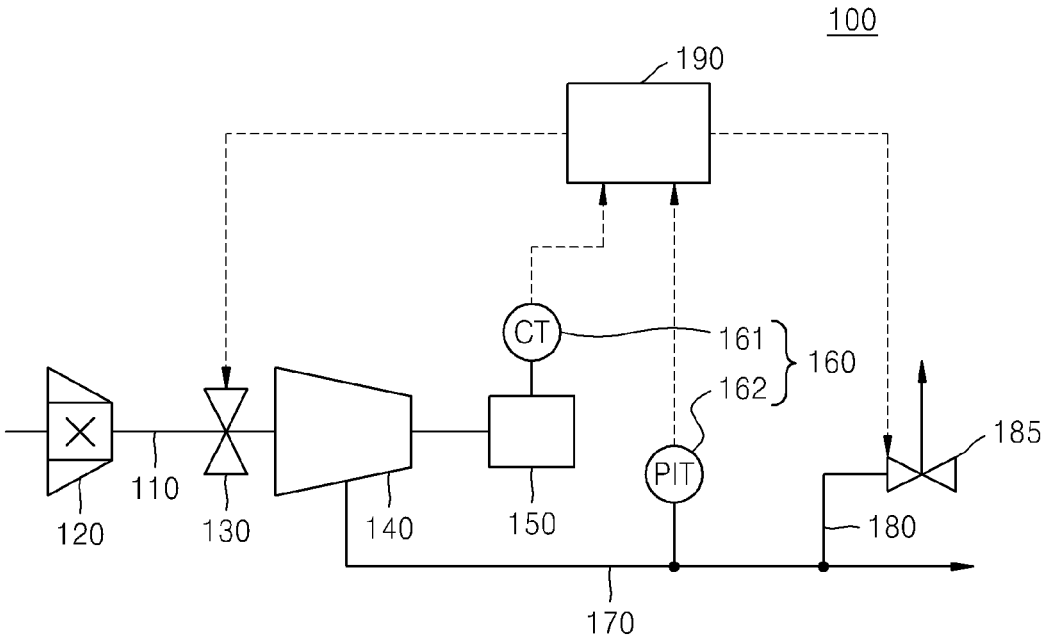
FIG. 1 is a circuit diagram showing a compressor system according to an exemplary embodiment.

Reference will now be made in detail to exemplary embodiments, examples of which are illustrated in the accompanying drawings, wherein like reference numerals refer to the like elements throughout. In this regard, the exemplary embodiments may have different forms and should not be construed as being limited to the descriptions set forth herein. Accordingly, the exemplary embodiments are merely described below, by referring to the figures, to explain aspects of the present description.

The terminology used herein is for the purpose of describing particular exemplary embodiments only and is not intended to be limiting of the inventive concept. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section.

FIG. 1 is a circuit diagram showing a compressor system 100 according to an exemplary embodiment.

Referring to FIG. 1, the compressor system 100 includes an intake line 110 for receiving a fluid from the outside, an impurity filter unit 120, which is installed on the intake line 110 and removes impurities from the fluid, and a compressor 140. Particularly, the impurity filter unit 120 may prevent impurities from being introduced into the compressor 140, thereby preventing the compressor 140 from being damaged.

The compressor system 100 may include an inlet guide vane 130, which is installed at the intake line 110 and controls flow of the fluid moving in the intake line 110 towards the compressor 140. The inlet guide vane 130 may be arranged between the impurity filter unit 120 and the compressor 140 and may control the flow of the fluid by controlling opening of the inlet guide vane 130.

The compressor 140 is connected to the intake line 110 and compresses the fluid introduced from the outside. Particularly, the compressor 140 may be a dynamic compressor, and more particularly, a turbine compressor.

The compressor system 100 may also include a driving unit that is connected to the compressor 140 and drives the compressor 140. The driving unit may include a motor 150 which transmits driving power to the compressor 140. Particularly, the motor 150 may be driven by a current or power applied from the outside.

Furthermore, the compressor system 100 may include an ejection line 170 connected to the compressor 140. The ejection line 170 may transfers a fluid compressed by the compressor 140 to an external device or a user.

The compressor system 100 may further include a branch line 180 that is branched from the ejection line 170. The branch line 180 may eject part of the fluid flowing in the ejection line 170 to the outside. Particularly, if a surge occurs in the compressor 140, the branch line 180 may reduce the surge by bypassing part of the fluid to the outside.

A blow-off valve 185 may be installed at the branch line 180. The blow-off valve 185 may control flow of a fluid flowing through the branch line 180. Particularly, flow of the fluid flowing through the branch line 180 may be controlled by opening the blow-off valve 185.

The compressor system 100 may also include a variable measuring sensor 160, which is installed on a side of the compressor 140 and measures variables influencing the performance of the compressor 140.

The variables are important factors for determining the performance curve of the compressor 140. The variables may include a first variable and a second variable different from the first variable. A performance chart of the compressor 140 may be formed based on the first variable and the second variable, wherein the first variable or the second variable may correspond to variables of the x-axis or the y-axis of the performance chart. Hereinafter, for convenience of explanation, descriptions will be given in relation to a case in which the first variable corresponds to a variable of the x-axis of the performance chart and the second variable corresponds to a variable of the y-axis of the performance chart.

The first variable may be a flow rate of a fluid introduced to the compressor 140, a current applied to the compressor 140, or power applied to the compressor 140. The second variable may be an ejection pressure of the compressor 140, a pressure ratio of the compressor 140, or an ejection head of the compressor 140. The pressure ratio of the compressor 140 may be calculated by dividing a pressure of a fluid ejected from the compressor 140 by a pressure of a fluid introduced to the compressor 140.

Each of the first variable and the second variable may be selected from among the above variables. When the first variable and the second variable are selected, a performance chart of the compressor 140 is formed. Charts that may be formed based on the first variable and the second variable may be similar to one another regardless of types of the first variable and the second variable.

When the first variable and the second variable are selected as described above, the variable measuring sensor 160 may be selected according to the first variable and the second variable. The variable measuring sensor 160 may be any of various sensors according to types of variables used to generate the performance chart.

In detail, the variable measuring sensor 160 may include a first variable measuring sensor unit 161 for measuring the first variable and a second variable measuring sensor unit 162 for measuring the second variable.

The first variable measuring sensor unit 161 may have any of various configurations according to the first variable. For example, if the first variable is a flow rate of a fluid introduced to the compressor 140, the first variable measuring sensor unit 161 may include a flow rate measuring sensor (not shown) that is installed at the intake line 110 and measures the flow rate of a fluid flowing in the intake line 110. Furthermore, if the first variable is current applied to the compressor 140, the first variable measuring sensor unit 161 may include a motor current sensor (not shown) for measuring the current applied to the motor 150. If the first variable is power applied to the compressor 140, the variable measuring sensor unit 161 may include a motor power sensor (not shown) for measuring the power applied to the motor 150.

Meanwhile, similar to the first variable measuring sensor unit 161, the second variable measuring sensor unit 162 may have any of various configurations. For example, if the second variable is an ejection pressure of the compressor 140, the second variable measuring sensor 162 may include a pressure measuring sensor (not shown) for measuring the ejection pressure at the ejection line 170. Furthermore, if the second variable is a pressure ratio, the second variable measuring sensor unit 162 may include a pressure ratio detecting sensor (not shown) for detecting the pressure ratio by measuring pressures at the intake line 110 and the ejection line 170. If the second variable is an ejection head temperature of the compressor 140, the second variable measuring sensor unit 162 may include a head temperature detecting sensor (not shown) for calculating the ejection head temperature by measuring temperature of the intake line 110.

The compressor system 100 may include a control unit 190 which controls the compressor 140, the motor 150, the inlet guide vane 130, and the blow-off valve 185. The control unit 190 may control the compressor 140, the motor 150, the inlet guide vane 130, and the blow-off valve 185 based on data received from the variable measuring sensor 160.

Detailed descriptions of the mechanism of the control unit 190 for controlling the compressor 140, the motor 150, the inlet guide vane 130, and the blow-off valve 185 is as follows.

Figure 2:
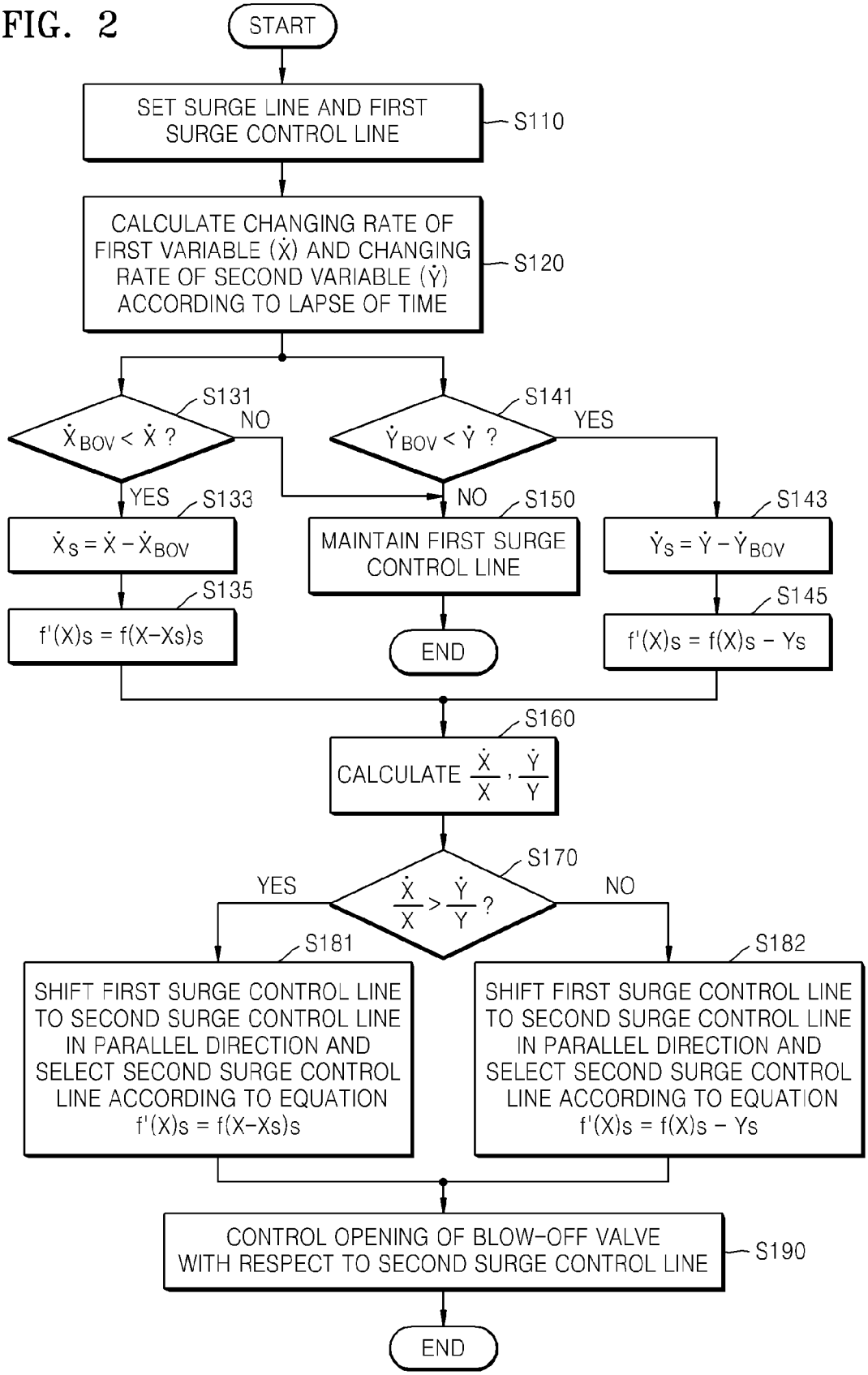
FIG. 2 is a block diagram showing an operation flow of the compressor system shown in FIG. 1.
Figure 3:
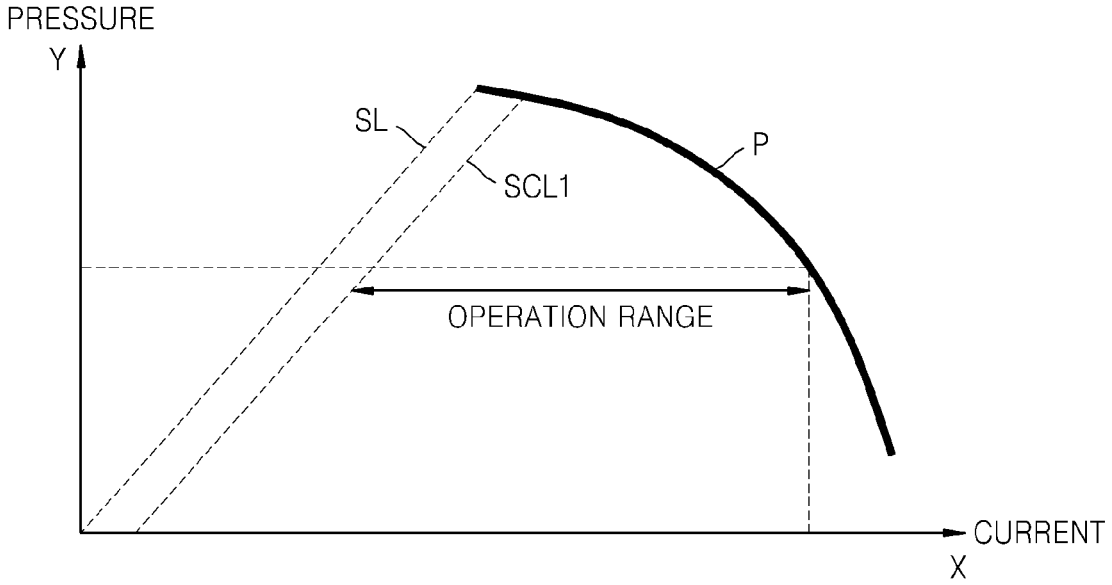
FIG. 3 is a graph showing a performance curve of the compressor system shown in FIG. 2.
Figure 4:
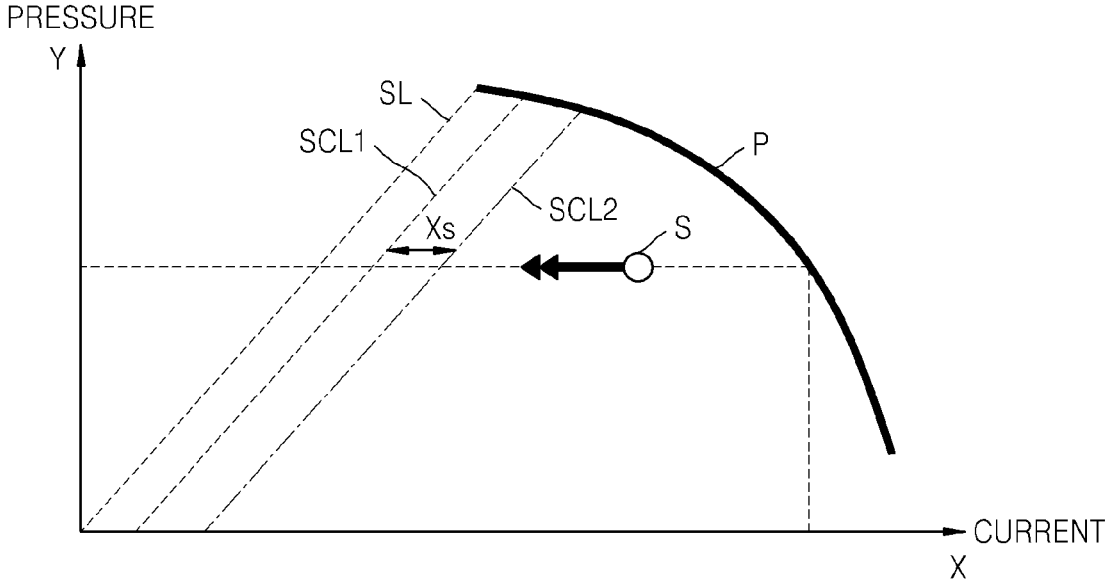
FIG. 4 is a graph showing the surge control line of the compressor system of FIG. 2 according to an exemplary embodiment.
Figure 5:
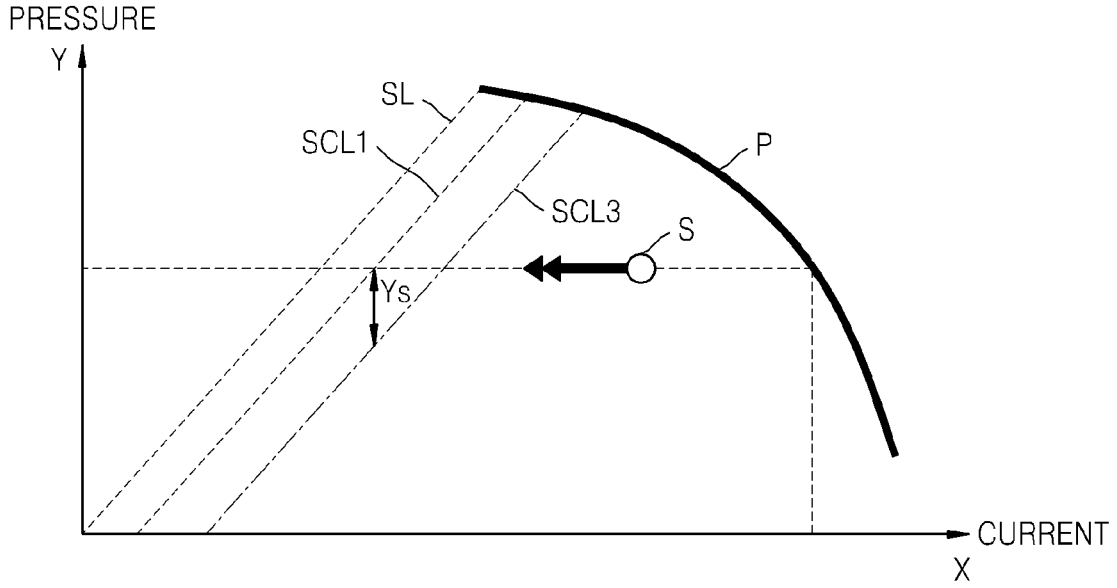
FIG. 5 is a graph showing the surge control line of the compressor system of FIG. 2 according to another exemplary embodiment.

FIG. 2 is a block diagram showing an operation flow of the compressor system 100 shown in FIG. 1. FIG. 3 is a graph showing a performance curve of the compressor system 100 shown in FIG. 2. FIG. 4 is a graph showing the surge control line of the compressor system 100 of FIG. 2 according to an exemplary embodiment. FIG. 5 is a graph showing the surge control line of the compressor system 100 of FIG. 2 according to another exemplary embodiment.

Referring to FIGS. 2 through 5, the compressor system 100 may operate in the order described below. The first variable and the second variable may be selected from among various variables as described above. Hereinafter, for convenience of explanation, it will be assumed below that the first variable is current applied to the motor 150 and the second variable is ejection pressure in the ejection line 170.

1. Driving of the Compressor System 100

In detail, when the compressor system 100 is driven, the compressor system 100 may receive an external signal from a user. When the external signal is input, the compressor system 100 is driven. A surge line SL that is set when the compressor system 100 is initially driven and a first surge control line SCL1 having a predetermined margin from the surge line SL may be set at the control unit 190 in advance. Particularly, the first surge control line SCL1 may be set to have about 10% margin from the surge line SL.

Referring to FIG. 3, a performance curve P of the compressor 140 may be set at the control unit 190 in advance. Furthermore, the surge line SL according to the performance curve P of the compressor 140 may be set at the control unit 190. As described above and shown in FIG. 2, the first surge control line SCL1 may also be set at the control unit 190 in advance based on the surge line SL (operation S110).

When the surge line SL and the first surge control line SCL1 are set as described above, the compressor 140 sets an operation point S at the right of the surge control line SCL1 and is driven based on the same as shown in FIG. 4.

Therefore, when the compressor system 100 is driven, the first surge control line SCL1 may prevent the surge that occurs if the operation point S of the compressor 140 overlaps the surge line SL.

2. Calculation of Changing Rate of First Variable and Changing Rate of Second Variable with Respect to Lapse of Time When the compressor system 100 is operated as described above, the control unit 190 may measure a current applied to the motor 150 and an ejection pressure in the ejection line 170 via the first variable measuring sensor unit 161 and the second variable measuring sensor unit 162, respectively. The current and the ejection pressure measured by the first variable measuring sensor unit 161 and the second variable measuring sensor unit 162 may be then transmitted to the control unit 190.

The control unit 190 may receive in real time the transmitted data regarding the measured current and the measured ejection pressure and calculate changing rates of the measured current and the measured ejection pressure with respect to lapse of time. In detail, the control unit 190 may calculate changing rates of the measured current and ejection pressure with respect to the lapse of time via Equations 1A and 1B below (operation S120).

$$\dot{X} = \frac{X_{t+\Delta t} - X_t}{\Delta t} \quad \text{[Equation 1A]}$$

$$\dot{Y} = \frac{Y_{t+\Delta t} - Y_t}{\Delta t} \quad \text{[Equation 1B]}$$

In the Equations 1A and 1B above, X denotes a first variable of a performance curve of a compressor, Y denotes a second variable of a performance curve of a compressor, $\dot{X}$ denotes a changing rate of the first variable with respect to lapse of time, $\dot{Y}$ denotes a changing rate of the second variable with respect to the lapse of time, $X_t$ denotes value of the first variable at a time point t, $X_{t+\Delta t}$ denotes value of the first variable after a time Δt is elapsed from the time point t, $Y_t$ denotes value of the first variable at a time point t, $Y_{t+\Delta t}$ denotes value of the first variable after a time Δt is elapsed from the time point t, and Δt denotes an arbitrary period of time or a period of time corresponding to one cycle of control program operation.

In Equations 1A and 1B above, X corresponds to the measured current, whereas Y corresponds to the measured ejection pressure.

3. Determination of Whether Changing Rate of a Variable is Out of a Preset Range of Changing Rate Variation When the changing rate of the first variable and the changing rate of the second variable are calculated, the control unit 190 may compare the changing rate of the first variable and the changing rate of the second variable. Particularly, the control unit 190 may determine whether the changing rate of the first variable and the changing rate of the second variable are out of preset ranges of changing rate variations.

The control unit 190 may compare the changing rate of the first variable and the changing rate of the second variable to first and second preset changing rates, respectively. Particularly, the first and second preset changing rates may be set differently based on whether the changing rate of the first variable is compared thereto or a case where the changing rate of the second variable is compared thereto. Detailed descriptions thereof will be given below.

1) Case when the Changing Rate of the First Variable is Compared to a First Preset Changing Rate (Operation S131)

The control unit 190 may compare the changing rate of the first variable to the first preset changing rate. The changing rate of the first variable may be a changing rate of the measured current as described above, whereas the preset changing rate may be the changing rate of current of the motor 150 that may be adjusted via opening of the blow-off valve 185.

In detail, when opening of the blow-off valve 185 is adjusted, a fluid ejected by the compressor 140 is separated into the ejection line 170 and the branch line 180, and thus, the fluid ejected by the compressor 140 may flow smoothly. Therefore, an ejection pressure of the compressor 140 varies, and thus, current applied to the motor 150 varies too.

The changing rate of current that varies as described above is determined based on opening of the blow-off valve 185. Therefore, the changing rate of current due to the opening of the blow-off valve 185 may be preset at the control unit 190.

Meanwhile, the control unit 190 may determine whether the changing rate of the measured current from the compressor 140 is out of the preset range of current changing rate variations described above. In detail, the control unit 190 may determine whether the changing rate of the measured current is greater than a preset changing rate of current.

2) Case when the Changing Rate of the Second Variable is Compared to a Second Preset Changing Rate (Operation S141)

The control unit 190 may compare the changing rate of the second variable to the second preset changing rate. The changing rate of the second variable may be a changing rate of an ejection pressure as described above, whereas the second preset changing rate may be a changing rate of an ejection pressure that may be adjusted via the blow-off valve 185.

In detail, when opening of the blow-off valve 185 is adjusted, a fluid ejected by the compressor 140 is separated into the ejection line 170 and the branch line 180, and thus, the fluid ejected by the compressor 140 may flow smoothly. Therefore, an ejection pressure of the compressor 140 varies, and thus current applied to the motor 150 varies.

The changing rate of a pressure that varies as described above is determined based on opening of the blow-off valve 185. Therefore, the changing rate of an ejection pressure due to the opening of blow-off valve 185 may be preset at the control unit 190.

Meanwhile, the control unit 190 may determine whether the changing rate of the measured ejection pressure from the compressor 140 is out of the second preset range of ejection pressure changing rate variations. In detail, the control unit 190 may determine whether the changing rate of the measured ejection pressure from the compressor 140 is greater than the preset changing rate of the ejection pressure.

4. Calculation of New Surge Control Line

When the measured changing rate of a variable is out of the preset range of changing rate variations, the control unit 190 may calculate a new surge control line. In detail, the control unit 190 may calculate different surge control lines according to changing rates of the measured first variable and the measured second variable. Detailed descriptions thereof will be given below.

1) Calculation of a New Surge Control Line According to the First Variable

The control unit 190 compares the changing rate of the measured current and the preset changing rate of current and determines whether the changing rate of the measured current is out of the preset range of current changing rate variations. For example, the control unit 190 may determine whether the changing rate of the measured current is greater than the preset changing rate of current.

If it is determined that the changing rate of the measured current is greater than the preset changing rate of current, the control unit 190 may change the first surge control line SCL1 to a second surge control line SCL2 as shown in FIGS. 4 and 5.

In detail, if it is determined that the changing rate of the measured current is greater than the preset changing rate of current, the control unit 190 may calculate a difference between the changing rate of the measured current and the preset changing rate of current. The control unit 190 may calculate the difference between the changing rate of the measured current and the preset changing rate of a current according to Equation 2 below (operation S133).

$$\dot{X}_S = \dot{X} - \dot{X}_{BOV} \quad \text{[Equation 2]}$$

In Equation 2 above, $\dot{X}_S$ denotes the difference between the changing rate of the measured current and the preset changing rate of current, $\dot{X}$ denotes the changing rate of the measured current, and $\dot{X}_{BOV}$ denotes the preset changing rate of current.

After the control unit 190 calculates the difference between the changing rate of the measured current and the preset changing rate of current, the first surge control line SCL1 may be changed to the second surge control line SCL2. The control unit 190 may shift the second surge control line SCL2 from the surge control line SCL1 in the x-axis direction of the performance chart by $X_S$ as shown in FIG. 5. Particularly, the control unit 190 may calculate the $X_S$ by multiplying Δt by $\dot{X}_S$.

In detail, the control unit 190 may shift the first surge control line SCL1 to the second surge control line SCL2 according to Equation 3 below (operation S135, refer to FIG. 4).

$$f'(X)_S = f(X - X_S)_S \quad \text{[Equation 3]}$$

In the above equation $f'(X)_S$ denotes a function for determining the second surge control line, and $f(X)_S$ denotes a function for determining the first surge control line.

2) Case when the Changing Rate of the Second Variable is Compared to a Second Preset Changing Rate Meanwhile, during the operation described above, the control unit 190 may calculate a second surge control line SCL3 according to the changing rate of an ejection pressure.

In detail, the control unit 190 compares the changing rate of the measured ejection pressure and the preset changing rate of pressure and determines whether the whether changing rate of the measured ejection pressure is out of the preset range of pressure. The control unit 190 may determine whether the changing rate of the measured ejection pressure is greater than the preset changing rate of pressure.

If it is determined that the changing rate of measured pressure is greater than the preset changing rate of pressure, the control unit 190 may change the first surge control line SCL1 to a second surge control line SCL3 as shown in FIG. 5.

In detail, if it is determined that the changing rate of the measured ejection pressure is greater than the preset changing rate of pressure, the control unit 190 may calculate a difference between the changing rate of the measured pressure and the preset changing rate of pressure. The control unit 190 may calculate the difference between the changing rate of a pressure and the preset changing rate of a pressure according to Equation 4 below (operation S143).

$$\dot{Y}_S = \dot{Y} - \dot{Y}_{BOV} \quad \text{[Equation 4]}$$

In the Equation 4 above, $\dot{Y}_S$ denotes the difference between the changing rate of the measured pressure and the preset changing rate of a pressure, $\dot{Y}$ denotes the changing rate of measured pressure, and $\dot{Y}_{BOV}$ denotes the preset changing rate of pressure.

After the control unit 190 calculates the difference between the changing rate of the measured pressure and the preset changing rate of pressure, the first surge control line SCL1 may be changed to the second surge control line SCL3. The control unit 190 may shift the second surge control line SCL3 from the surge control line SCL1 in the y-axis direction of the performance chart by $Y_S$. Particularly, the control unit 190 may calculate the $Y_S$ by multiplying Δt by $\dot{Y}_S$.

In detail, the control unit 190 may shift the first surge control line SCL1 to the second surge control line SCL3 according to Equation 5 below (operation S145, refer to FIG. 5).

$$f'(X)_S = f(X)_S - Y_S \quad \text{[Equation 5]}$$

In the Equation 5 above, $f'(X)_S$ denotes a function for determining the second surge control line, and $f(X)_S$ denotes a function for determining the first surge control line.

5. Calculating First Parameter and Second Parameter by Non-Dimensionalizing Changing Rate of First Variable and Changing Rate of Second Variable After the control unit 190 calculates the second surge control lines SCL2 or SCL3, the control unit 190 may calculate a first parameter and a second parameter. The control unit 190 may calculate the first parameter and the second parameter as shown in Equations 6A and 6B below. In this case, $\dot{X}$ and $\dot{Y}$ may be calculated as shown in Equations 1A and 1B above (operation S160).

$$P1 = \frac{\dot{X}}{X} \quad \text{[Equation 6A]}$$

$$P2 = \frac{\dot{Y}}{Y} \quad \text{[Equation 6B]}$$

In the Equations 6A and 6B above, P1 and P2 respectively denote the first parameter and the second parameter, X denotes current currently applied to a compressor, $\dot{X}$ denotes a changing rate of the measured current, Y denotes a current ejection pressure of the compressor, and $\dot{Y}$ denotes a changing rate of the measured ejection pressure.

6. Operation for Selecting a Control Reference Value Based on the First Parameter or the Second Parameter.

After the control unit 190 calculates the first parameter P1 and the second parameter P2 as described above, the control unit 190 may compare the first parameter P1 and the second parameter P2. The control unit 190 may select the greater one of the first parameter or the second parameter as a control reference value.

In detail, the control unit 190 compares the first parameter P1 and the second parameter P2 and, if the first parameter P1 is greater than the second parameter P2, the control unit 190 may select the first parameter P1 as the control reference value (operation S170).

On the contrary, the control unit 190 compares the first parameter P1 and the second parameter P2 and, if the first parameter P1 is smaller than the second parameter P2, the control unit 190 may select the second parameter P2 as the control reference value (operation S170). Furthermore, if the first parameter P1 is identical to the second parameter P2, the control unit 190 may select the first parameter P1 or the second parameter P2 arbitrarily as the control reference value.

7. Selecting and Changing Surge Control Line Corresponding to Control Reference Value The control unit 190 may select the control reference value via the comparison of the first and second parameters as described above and select and change the surge control line.

In detail, if the control unit 190 selects the control reference value corresponding to the first parameter P1, the control unit 190 may shift the first surge control line SCL1 to the second surge control line SCL2 having the same slope as the first surge control line SCL 1. That is, the second surge control line SCL2 extends in a parallel direction as the first surge control line SCL1. Particularly, the control unit 190 may determine the second surge control line SCL2 according to Equation 3 above (operation S181).

On the contrary, if the control unit 190 selects the control reference value corresponding to the second parameter P2, the control unit 190 may shift the first surge control line SCL1 to the second surge control line SCL3 having the same slope as the first surge control line SCL 1. That is, the second surge control line SCL3 extends in a parallel direction as the first surge control line SCL1. Particularly, the control unit 190 may determine the second surge control line SCL3 according to Equation 5 above (operation S182).

Meanwhile, if the first parameter is identical to the second parameter, the control unit 190 may determine the second surge control lines SCL2 or SCL3 according to Equation 3 or Equation 5 above. For convenience of explanation, it will be assumed below that, if the first parameter is identical to the second parameter P2, the second surge control line SCL3 is determined according to Equation 5 above.

In this case, when the second surge control lines SCL2 and SCL3 are determined, the second surge control lines SCL2 and SCL3 are shifted to the right of the first surge control line SCL1 extending in a parallel direction with the first surge control line SCL1 (refer to FIGS. 4 and 5). Furthermore, when the second surge control lines SCL2 and SCL3 are determined as described above, the compressor system 100 may be controlled based on the second surge control lines SCL2 and SCL3.

8. Controlling of Opening of Blow-Off Valve

When the second surge control lines SCL2 and SCL3 are determined as described above, the control unit 190 may control opening of the blow-off valve 185 based on the second surge control lines SCL2 and SCL3. In detail, when the second surge control lines SCL2 and SCL3 are determined, the control unit 190 may control the blow-off valve 185 to be opened more widely (operation S190).

Therefore, the compressor system 100 and the method of controlling the same according to an exemplary embodiment may actively manage abrupt changes of a process at the compressor system 100 and prevent occurrence of a surge in the compressor 140.

In detail, when a surge occurs, the compressor 140 is unable to supply a fluid normally, thereby ceasing entire operations. If the entire operations are ceased at a petrochemical industry complex or a large-scale manufacturing factory in which compressors like the compressor 140 are widely used, significantly damages may occur, and thus, prevention of surges that affect the normal operation of the compressor 140 may be considered as the core feature of controlling the compressor 140. Since the compressor system 100 and the method of controlling the same according to an exemplary embodiment may prevent occurrence of surges by actively changing surge control lines as described above, the stability of the compressor system 100 may be improved.

Furthermore, when a surge occurs, reverse flow of a fluid occurs in the compressor 140, thereby causing mechanical oscillations. The compressor 140 is a high-speed revolution unit, and when an oscillation occurs, a revolving shaft or a bearing of the compressor 140 may be damaged, thereby causing malfunction or lifespan reduction of components the compressor 140. However, if the compressor system 100 and the method of controlling the same according to an exemplary embodiment are applied, occurrence of a surge may be significantly reduced, and thus, ease of maintenance and lifespan increase of the components of the compressor 140 may be expected.

Since it is not necessary to add separate devices to a compressor system in the related art to embody the compressor system 100 and the method of controlling the same, manufacturing equipment therefor may be simplified. Furthermore, since the compressor system 100 and the method of controlling the same may be applied to a compressor system in the related art, costs and manpower for replacement may be reduced.

While exemplary embodiments have been particularly shown and described above, it would be appreciated by those skilled in the art that various changes may be made therein without departing from the principles and spirit of the present inventive concept as defined by the following claims.

What is claimed is:

1. A method of controlling a compressor, the method comprising:

measuring, by a variable measuring sensor arranged at a side of the compressor, variables for generating a performance curve of the compressor;

calculating, by a controller implemented by at least one processor, changing rates of the variables;

comparing, by the controller, the calculated changing rates with preset changing rate variations;

determining, by the controller, a surge control line different from a preset surge control line for the compressor according to the calculated changing rates in response to the calculated changing rates being out of ranges of the preset changing rate variations;

controlling, by the controller, an amount of opening of a blow-off valve based on the determined surge control line; and calculating, by the controller, a first parameter and a second parameter by non-dimensionalizing the changing rate of a first variable and the changing rate of a second variable, wherein the variables comprise the first variable and the second variable different from the first variable, wherein the first parameter and the second parameter are calculated according to equations $$P1 = \frac{\dot{X}}{X} \text{ and } P2 = \frac{\dot{Y}}{Y},$$

and wherein the P1 and P2 denote the first parameter and the second parameter, X denotes the first variable of the compressor, $\dot{X}$ denotes a changing rate of the first variable, Y denotes the second variable of the compressor, and $\dot{Y}$ denotes the changing rate of the second variable.

2. The method of claim 1 further comprising selecting, by the controller, a greater one of the first parameter and the second parameter as a control reference value.

3. The method of claim 2, further comprising selecting and changing, by the controller, the surge control line corresponding to the control reference value.

4. The method of claim 1, wherein the preset changing rate variations comprise a changing rate of the first variable and a changing rate of the second variable, the changing rates changed by adjusting, by the controller, the opening of the blow-off valve with respect to a lapse of time.

5. The method of claim 1, wherein the surge control line is shifted from the preset surge control line according to a difference between the calculated changing rate of the variables and the preset changing rate variations.

6. The method of any of claim 1, wherein the first variable comprises any one of a flow introduced to the compressor, a current applied to the compressor, and power applied to the compressor.

7. The method of any of claim 1, wherein the second variable comprises any one of an ejection pressure of the compressor, a pressure ratio of the compressor, and an ejection head of the compressor.

8. A compressor comprising:

a compressor configured to compress a fluid from the outside;

a variable measuring sensor arranged at a side of the compressor configured to measure variables for generating a performance curve of the compressor; and a controller implemented by an at least one processor configured to calculate a changing rate of the measured variables, compare the calculated changing rate with a preset changing rate variations, determine a surge control line that is different from a preset surge control line for the compressor, and calculate a first parameter and a second parameter by non-dimensionalizing the changing rate of a first variable and the changing rate of a second variable, wherein the variables comprise the first variable and the second variable different from the first variable, wherein the first parameter and the second parameter are calculated according to equations $$P1 = \frac{\dot{X}}{X} \text{ and } P2 = \frac{\dot{Y}}{Y},$$

wherein the P1 and P2 denote the first parameter and the second parameter, X denotes the first variable of the compressor, $\dot{X}$ denotes a changing rate of the first variable, Y denotes the second variable of the compressor, and $\dot{Y}$ denotes the changing rate of the second variable, and wherein the controller is configured to control an amount of opening of a blow-off valve based on the determined surge control line.

9. The compressor of claim 8, further comprising;

an ejection line that is connected to the compressor and ejects a fluid compressed by the compressor; and a branch line which is branched from the ejection line; and wherein the blow-off valve is installed on the branch line and is configured to control flux of the fluid flowing into the branch line and exiting the compressor.

10. The compressor of claim 9, wherein the variables comprise a first variable and a second variable different from the first variable.

11. The compressor of claim 9, wherein the preset changing rate variations comprise a changing rate of the first variable and a changing rate of the second variable, the changing rates changed by adjusting the opening of the blow-off valve with respect to lapse of time.

12. The compressor of claim 10, wherein the controller is configured to calculate a first parameter and a second parameter by non-dimensionalizing the changing rate of the first variable and the changing rate of the second variable.

13. The compressor of claim 12, wherein the controller is configured to select a greater one of the first parameter and the second parameter as a control reference value.

14. The compressor of claim 13, wherein the controller is configured to change the surge control line based on the control reference value.

15. The compressor of claim 8, wherein the surge control line is shifted from the preset surge control line according to a difference between the calculated changing rate of the measured variables and the preset changing rate variations.

16. The method of claim 1, wherein the variables comprise measured current and measured ejection pressure.

17. The compressor of claim 8, wherein the variables comprise measured current and measured ejection pressure.

18. The method of claim 1, wherein the determining the surge control line comprises determining the surge control line different from the preset surge control line for the compressor according to the calculated changing rates prior to occurrence of a surge in the compressor.

19. The compressor of claim 8, wherein the controller determines the surge control line that is different from the preset surge control line for the compressor prior to occurrence of a surge in the compressor.

* * * * *